US010417980B2

(12) United States Patent
Lee et al.

(10) Patent No.: US 10,417,980 B2
(45) Date of Patent: Sep. 17, 2019

(54) LIQUID CRYSTAL DISPLAY DEVICE AND DRIVING METHOD THEREOF

(71) Applicant: LG Display Co., Ltd., Seoul (KR)

(72) Inventors: Joohee Lee, Incheon (KR); Yongwon Jo, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 46 days.

(21) Appl. No.: 15/716,128

(22) Filed: Sep. 26, 2017

(65) Prior Publication Data

US 2018/0096662 A1 Apr. 5, 2018

(30) Foreign Application Priority Data

Sep. 30, 2016 (KR) ..... 10-2016-0127111

(51) Int. Cl.
*G09G 3/36* (2006.01)

(52) U.S. Cl.
CPC ..... *G09G 3/3614* (2013.01); *G09G 3/3648* (2013.01); *G09G 3/3655* (2013.01); *G09G 3/3696* (2013.01); *G09G 2310/065* (2013.01); *G09G 2320/0209* (2013.01); *G09G 2320/0219* (2013.01); *G09G 2320/0276* (2013.01); *G09G 2360/16* (2013.01); *G09G 2370/08* (2013.01)

(58) Field of Classification Search
CPC .. G09G 3/3614; G09G 3/3648; G09G 3/3655; G09G 3/3696; G09G 2310/065; G09G 2320/0209; G09G 2320/0219; G09G 2320/0276; G09G 2360/16; G09G 2370/08
See application file for complete search history.

(56) References Cited

U.S. PATENT DOCUMENTS 4,675,667 A 6/1987 Nakamura et al.
2002/0195955 A1 12/2002 Kudo et al.
2007/0001978 A1* 1/2007 Cho ..... G09G 3/3655 345/98
2007/0164952 A1 7/2007 Kim
(Continued)

FOREIGN PATENT DOCUMENTS

KR 2014-0043200 A 4/2014

OTHER PUBLICATIONS

European Search Report (partial), dated Feb. 13, 2018 for the European patent application No. 17192302.2.
(Continued)

*Primary Examiner* — Lisa S Landis
(74) *Attorney, Agent, or Firm* — Polsinelli PC

(57) ABSTRACT

A liquid-crystal display device and a driving method thereof are disclosed. The driving method of the liquid-crystal display device comprises: converting data of an input image into a positive gamma reference level voltage and a negative gamma reference voltage to generate a positive data voltage and a negative data voltage; selecting between the positive data voltage and the negative data voltage in response to a polarity control signal and supplying the selected data voltage to data lines; generating a compensated voltage based on the difference between a dummy data voltage and a preset gamma reference level voltage; and increasing the high-potential power supply voltage by an amount equal to the compensated voltage and decreasing the low-potential power-supply voltage by the amount equal to the compensated voltage.

20 Claims, 14 Drawing Sheets

(56) References Cited

U.S. PATENT DOCUMENTS

| | | | | |
|---|---|---|---|---|
| 2009/0284456 | A1 | 11/2009 | Song et al. | |
| 2010/0033414 | A1* | 2/2010 | Jeong | G09G 3/3655 345/89 |
| 2010/0271294 | A1 | 10/2010 | Chen et al. | |
| 2014/0092077 | A1 | 4/2014 | Kim et al. | |
| 2016/0070147 | A1 | 3/2016 | Kim et al. | |
| 2016/0189642 | A1 | 6/2016 | Shin et al. | |

OTHER PUBLICATIONS

Communication dated Jun. 28, 2018 issued in the corresponding European Patent Application No. 17192302.2, pp. 1-21.

* cited by examiner

LIQUID CRYSTAL DISPLAY DEVICE AND DRIVING METHOD THEREOF

CROSS-REFERENCE TO RELATED APPLICATION

This application claims the priority benefit of Korean Patent Application No. 10-2016-0127111 filed on Sep. 30, 2016, the entire contents of which is incorporated herein by reference in its entirety for all purposes as if fully set forth herein.

BACKGROUND

Field of the Disclosure

The present disclosure relates to a display device, and more particularly, to a liquid crystal display device capable of allowing the common voltage to reach a target voltage within a limited time and a driving method thereof.

Description of the Background

Various flat panel displays are available in the market, including liquid crystal display devices (LCDs) and organic light-emitting diode displays (hereinafter, "OLED displays"). A liquid-crystal display device displays an image by controlling an electric field applied to liquid-crystal molecules according to a data voltage. In an active matrix display device, each pixel has a thin-film transistor (hereinafter, "TFT").

The liquid-crystal display device comprises a plurality of source drive integrated circuits (SICs) for supplying data voltages to data lines on a display panel, a plurality of gate drive ICs for sequentially supplying gate pulses (or scan pulses) to gate lines (or scan lines) on the display panel, and a timing controller for controlling the drive ICs.

The pixels of the liquid-crystal display device include red (R), green (G), and blue (B) sub-pixels to produce colors. In the liquid-crystal display device, the polarity of data voltages applied to the sub-pixels is reversed in order to reduce afterimages and flicker. The polarity of data voltages can be reversed by dot inversion, line inversion, column inversion, etc. A dot is a sub-pixel. In the dot inversion method, data voltages applied to adjacent sub-pixels in vertical and horizontal directions are controlled to be opposite in polarity. In the line inversion method, data voltages applied to adjacent lines are controlled to be opposite in polarity. Here, a line refers to a row line in which pixels are arranged horizontally on a pixel array of the display panel. In the line inversion method, common voltage Come may be reversed to a polarity opposite to that of data voltages in order to reduce data voltage swing. In the column inversion method, data voltages applied to adjacent columns are controlled to be opposite in polarity. Here, a column refers to a column line in which pixels are arranged vertically on a pixel array of the display panel.

To test image quality in a liquid-crystal display device, a test pattern shown in FIG. 1 may be used in a liquid-crystal display device testing process. In the testing process, a stripe pattern shown in FIG. 1, in which a pixel charged with a white-level voltage and a pixel charged with a black-level voltage alternate with each other, is applied to the liquid-crystal display device and displayed for a certain amount of time, and then the voltage applied to the center of the screen is adjusted to a white-level or intermediate gray-level voltage in between the white level and the black level. As a result, a common voltage shift occurs depending on the position on the screen, thus causing crosstalk. This is because, due to the coupling between a pixel electrode of a liquid-crystal cell and a common electrode, the common voltage applied to the common electrode shifts with a change in the data voltage applied to the pixel electrode.

The polarity of data voltages when the test pattern of FIG. 1 is displayed on the screen of the liquid-crystal display device is as shown in FIG. 2. FIG. 2 is a view of a portion of the test pattern of FIG. 1 indicated with the polarity of data voltages. As is the case when a normal image is input, the data voltages on the test pattern are inverted by horizontal and vertical 1-dot inversion. In the horizontal and vertical 1-dot inversion method, the data voltages supplied to horizontally adjacent liquid-crystal cells are opposite in polarity, and the data voltages supplied to vertically adjacent liquid-crystal cells are opposite in polarity.

Referring to FIG. 3, for the pixels in the A line to which data voltage of white gray level is applied, the R data voltage and the B data voltage have positive polarity, and the G data voltage has negative polarity. Hence, in the A line, positive data voltage is dominant over negative data voltage (+ polarity dominant). As a result, a ripple in common voltage Come occurs to the positive side of the A line, and therefore the common voltage Come shifts towards the positive side. Moreover, the G data voltage applied as positive black voltage +Black in the previous frame changes to negative white voltage −White in the current frame, thereby increasing the voltage difference in G data voltage.

Referring to FIG. 4, for the pixels in the B line to which data voltage of white gray level is applied, the R data voltage and the B data voltage have negative polarity, and the G data voltage has positive polarity. Hence, in the B line, negative voltage is dominant over positive voltage (− polarity dominant). As a result, a ripple in common voltage Come occurs to the negative side of the B line, and therefore the common voltage Come shifts towards the negative side. Moreover, the G data voltage applied as negative black voltage −Black in the previous frame changes to positive white voltage +White in the current frame, thereby increasing the voltage difference in G data voltage.

In liquid-crystal display devices, when adjacent pixels receive data voltage involving a large voltage difference in data voltage, such as a voltage of white gray level and a voltage of black gray level, smear or crosstalk causes due to a polarity bias in data voltage. The ripple in common voltage Come is more distinct in the line inversion method in which polarity is reversed with every row line.

To reduce the ripple in common voltage Vcom, the common voltage Vcom applied to the display panel may be fed back to an inverting amplifier. In this method, however, when there is a large ripple in common voltage due to a large variation in data voltage, it may not be possible to reach a target voltage that can prevent the ripple in common voltage within a limited amount of time.

SUMMARY

The present disclosure provides a liquid-crystal display device capable of allowing common voltage to reach a target voltage within a limited amount of time, and a driving method thereof.

To achieve these and other advantages and in accordance with the purpose of the present disclosure, a liquid crystal display device includes: a display panel comprising a pixel electrode to which a data voltage for an input image is applied and a common electrode to which a common voltage is applied; a target level generator that outputs target level data for every horizontal period according to the result of analysis of data of the input image; and a multi-step common voltage generator that outputs a target voltage corresponding to the target level data and a reference level voltage corresponding to preset reference data within 1 horizontal period and outputs the common voltage to the common electrode. The common voltage is generated as a first target voltage within a first horizontal period and as a second target voltage within a second horizontal period, the reference level voltage is generated for ½ horizontal period or less, between the first target voltage and the second target voltage, and the reference level voltage is lower than the first target voltage and higher than the second target voltage.

The multi-step common voltage generator receives the target level data via serial peripheral interface (SPI) communication and outputs the reference level voltage for a period of time less than the minimum transfer time allowed for the SPI communication.

The multi-step common voltage generator includes: a common voltage selector that receives an SPI enable signal, serial data comprising the target level data, and clocks, and that generates a selection signal of first logical value when the high width of the SPI enable signal is i clocks or more (i is a positive integer equal to or greater than 2), and generates a selection signal of second logical value when the high width of the SPI enable signal is j clocks (j is a positive integer equal to or greater than 1 and less than i); an SPI receiver that receives the SPI enable signal, the serial data, and the clocks; a first register that receives the target level data from the SPI receiver; a second register that is separated from the SPI communication path and stores the reference level data; and a voltage output part that selects between voltages respectively corresponding to the target level data and reference level data received through a multiplexer, The multiplexer supplies the target level data from the first register to the voltage output part in response to the selection signal of first logical value, and supplies the reference level data from the second register to the voltage output part in response to the selection signal of second logical value, wherein i is 2 and j is 1.

A reference level interval for the common voltage is varied depending on the transition width of the common voltage between the first and second target voltages.

The common voltage selector compares first target level data indicating the first target voltage and second target level data indicating the first target voltage, and provides reference level interval for the common voltage for a period of time longer than 0 and shorter than the ½ horizontal period when the transition width between the first and second target voltages is greater than a given reference value, and controls the reference level interval to a minimum when the transition width is less than the reference value.

To achieve these and other advantages and in accordance with the purpose of the present disclosure, a driving method of a liquid-crystal display device comprising a display panel comprising a pixel electrode to which a data voltage for an input image is applied and a common electrode to which a common voltage is applied, the method includes: outputting target level data for every horizontal period according to the result of analysis of data of the input image; and outputting a target voltage corresponding to the target level data and a reference level voltage corresponding to preset reference data within 1 horizontal period and outputting the common voltage to the common electrode. The common voltage is generated as a first target voltage within a first horizontal period and as a second target voltage within a second horizontal period, the reference level voltage is generated for ½ horizontal period or less, between the first target voltage and the second target voltage, and the reference level voltage is lower than the first target voltage and higher than the second target voltage.

BRIEF DESCRIPTION OF THE DRAWINGS

The accompanying drawings, which are included to provide a further understanding of the disclosure and are incorporated in and constitute a part of the present disclosure, illustrate aspects of the disclosure and together with the description serve to explain the principles of the disclosure.

In the drawings.

DETAILED DESCRIPTION

Figure 1:
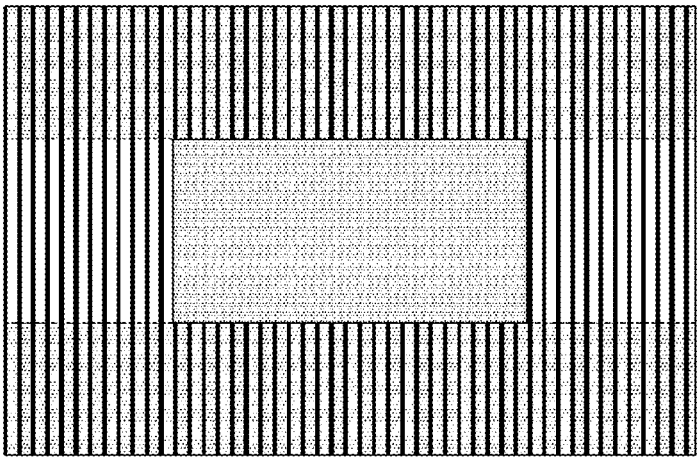
FIG. 1 (RELATED ART)
FIG. 1 is a schematic view showing a test pattern for testing crosstalk according to the related art.
Figure 2:
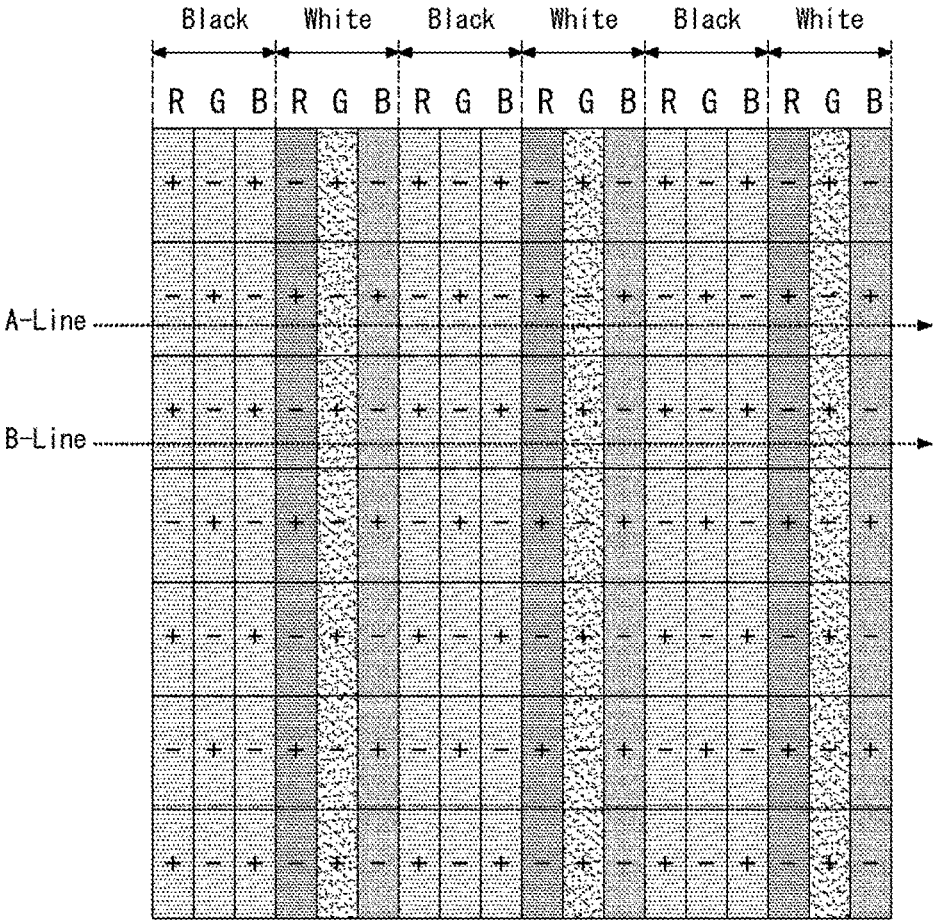
FIG. 2 (RELATED ART)
FIG. 2 is an enlarged view showing a portion of the test pattern of FIG. 1 indicated with the polarity of data voltages.
Figure 3:
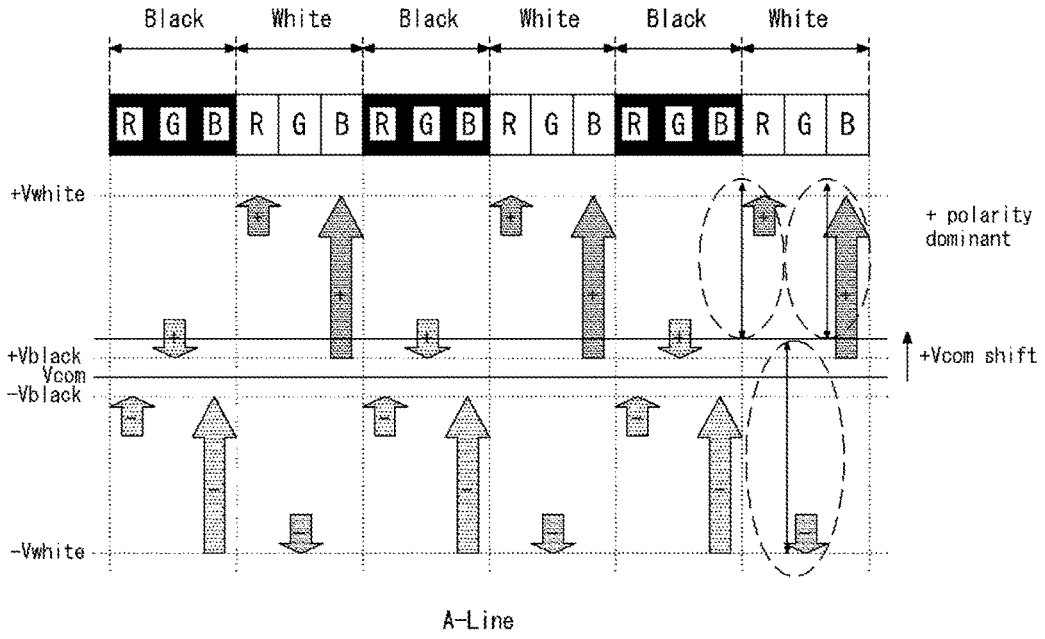
FIG. 3 (RELATED ART)
FIG. 3 is a view showing a polarity bias in data voltage in the A line of FIG. 2.
Figure 4:
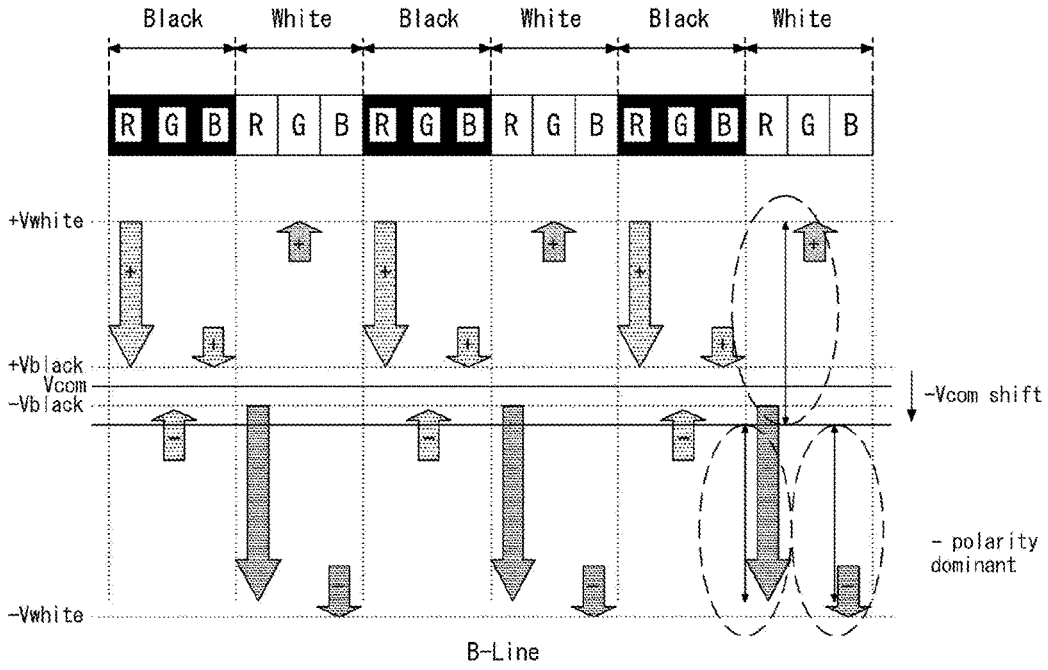
FIG. 4 (RELATED ART)
FIG. 4 is a view showing a polarity bias in data voltage in the B line of FIG. 2.

Reference will now be made in detail to aspects of the present disclosure, examples of which are illustrated in the accompanying drawings. However, the present disclosure is not limited to aspects disclosed below, and may be implemented in various forms. These aspects are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing aspects of the present disclosure are merely exemplary, and the present disclosure is not limited thereto unless specified as such. Like reference numerals designate like elements throughout. In the following description, when a detailed description of certain functions or configurations related to this document that may unnecessarily cloud the gist of the disclosure have been omitted.

In the present disclosure, when the terms "include", "have", "comprised of", etc. are used, other components may be added unless "~ only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above", "under or below", "next to" another structure, this description should be construed as including a case in which the structures directly contact each other as well as a case in which a third structure is disposed therebetween.

The terms "first", "second", etc. may be used to describe various components, but the components are not limited by such terms. The terms are used only for the purpose of distinguishing one component from other components. For example, a first component may be designated as a second component, and vice versa, without departing from the scope of the present disclosure.

The features of various aspects of the present disclosure can be partially combined or entirely combined with each other, and can be technically interlocking-driven in various ways. The aspects can be independently implemented, or can be implemented in conjunction with each other.

Reference will now be made in detail to aspects of the disclosure, examples of which are illustrated in the accompanying drawings. Wherever possible, the same reference numbers will be used throughout the drawings to refer to the same or like parts. Detailed descriptions of known arts will be omitted if such may mislead the aspects of the disclosure.

Figure 5:
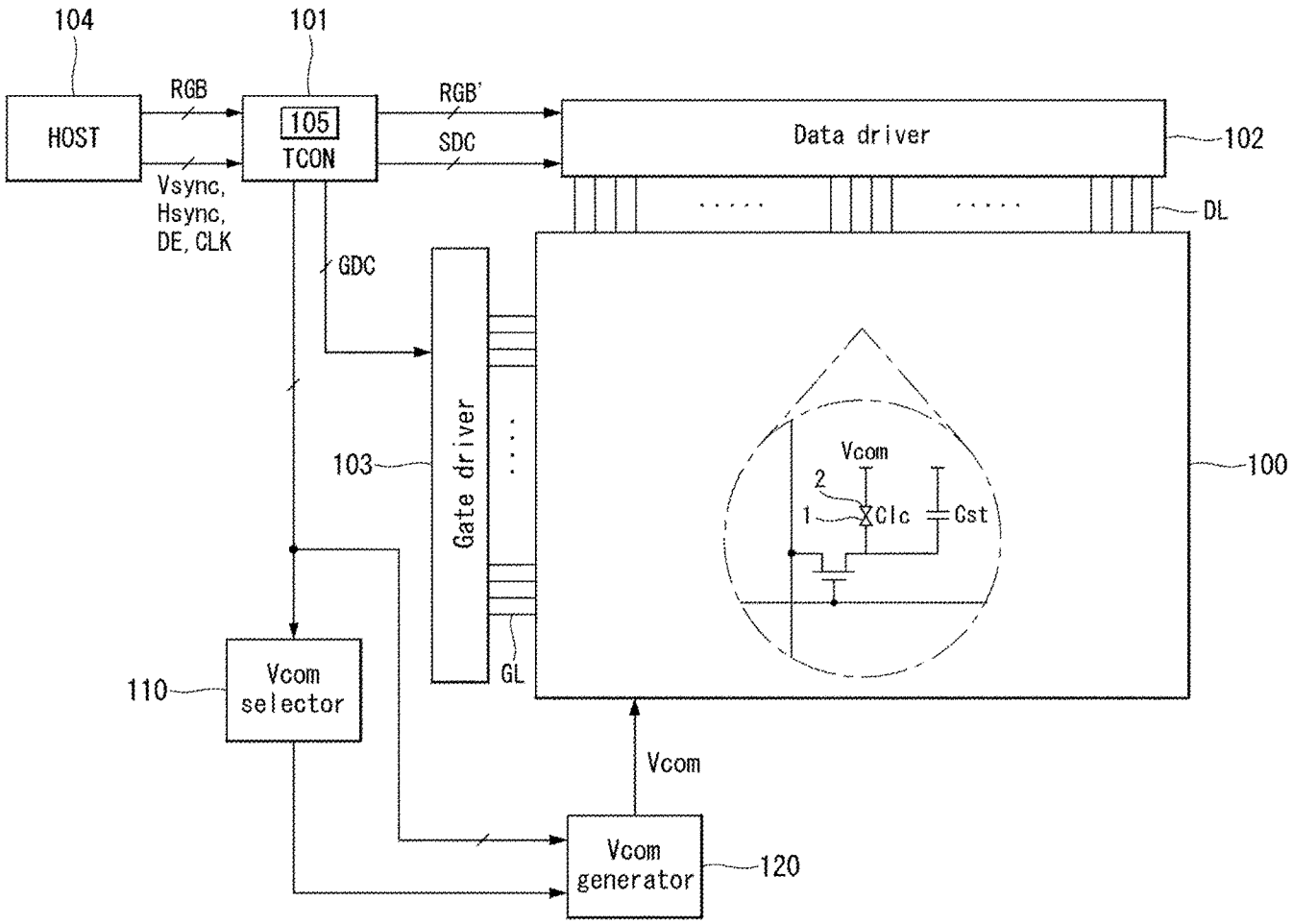
FIG. 5 is a block diagram showing a liquid-crystal display device according to an exemplary aspect of the present disclosure.

FIG. 5 is a block diagram showing a liquid-crystal display device according to an exemplary aspect of the present disclosure.

Referring to FIG. 5, the liquid-crystal display device according to the present disclosure comprises a display panel 100, a timing controller 101, a data driver 102, and a gate driver 103.

The liquid-crystal display device according to the present disclosure further comprises a target level generator 105 and a multi-step common voltage generator. The multi-step common voltage generator outputs a target voltage corresponding to target level data for common voltage and a reference level voltage corresponding to preset reference data within 1 horizontal period to output a multi-step common voltage. The common voltage output from the multi-step common voltage generator is generated as a first target voltage within a first horizontal period and as a second target voltage within a second horizontal period. The reference level voltage is between the first target voltage and the second target voltage. The reference level voltage is lower than the first target voltage and higher than the second target voltage.

The multi-step common voltage generator comprises a Vcom selector 110 and a Vcom generator 120. Either or both of the target level generator 105 and the Vcom selector 110 may be integrated in a single chip, along with the timing controller 101.

The display panel 100 may be implemented in various liquid crystal modes, such as a TN (Twisted Nematic) mode, a VA (Vertical Alignment) mode, an IPS (In-Plane Switching) mode, and an FFS (Fringe Field Switching) mode. This liquid-crystal display device may be implemented as any type of display device, including a transmissive liquid crystal display, a semi-transmissive liquid crystal display, and a reflective liquid crystal display. The transmissive liquid crystal display and the semi-transmissive liquid crystal display require a backlight unit. The backlight unit may be implemented as a direct-type backlight unit or an edge-type backlight unit.

The display panel 100 comprises a liquid crystal layer formed between two substrates. A screen of the display panel 100 comprises pixels that are arranged in a matrix form by the intersections of data lines DL and gate lines GL. Each pixel includes a red sub-pixel R, a green sub-pixel G, and a blue sub-pixel B, and may further comprise a white sub-pixel W. Each sub-pixel comprises a liquid crystal cell Clc. Touch sensors for sensing touch input may be disposed on the screen of the display panel 100. The touch sensors may be on-cell type touch sensors or add-on type touch sensors, and may be disposed on the display panel 100. To drive such touch sensors, a touch sensor driver (not shown) may be added to a drive circuit for the liquid-crystal display device. The touch sensor driver receives an output signal from a touch sensor, creates the coordinates of each touch input, and sends them to a host system (HOST) 104.

A TFT array is formed on the lower substrate of the display panel 100. The TFT array comprises liquid crystal cells Clc formed between the intersections of data lines DL and gate lines GL, TFTs connected to pixel electrodes 11 of the liquid crystal cells Clc, and storage capacitors Cst. The liquid crystal cells Clc are connected to the TFTs and driven by an electric field applied to the pixel electrodes 1 and a common electrode 2. A color filter array comprising a black matrix, color filters, etc. is formed on the upper substrate of the display panel 100. Polarizers are attached to the upper and lower substrates of the display panel 100, and alignment layers for setting a pre-tilt angle of liquid crystals are formed on the upper and lower substrates. In a COT (Color filter On TFT) or TOC (TFT On Color filter) structure, the TFT array and the color filter array may be stacked on one substrate.

The timing controller (TCON) 101 sends digital video data RGB for an input image received from the host system 104 to the data driver 102. The timing controller 101 receives timing signals, such as a vertical synchronization signal Vsync, a horizontal synchronization signal Hsync, a data enable signal DE, and a main clock MCLK from the host system 104. The timing controller 101 generates timing control signals SDC and GDC for controlling the operation timings of the data driver 102 and gate driver 103, based on the timing signals.

The gate timing control signal GDC comprises a gate start pulse GSP, a gate shift clock GSC, and a gate output enable signal GOE. The gate start pulse GSP controls the operation start timing of the gate driver 103. The gate shift clock GSC controls the shift timing of a gate pulse. The gate output enable signal GOE controls the output timing of the gate pulse. The gate output enable signal GOE may be omitted. A shift register of the gate driver 103, along with the TFT array, may be formed on a substrate of the display panel 100.

The data timing control signal SDC comprises a source start pulse SSP, a source sampling clock SSC, a polarity control signal POL, and a source output enable signal SOE. The source start pulse SSP controls the start timing of data sampling of the data driver 102. The source sampling clock SSC is a clock signal that controls the timing of data sampling. The source output enable signal SOE controls the output timing of data voltage. The source start pulse SSP and the source sampling clock SSC may be omitted. The polarity control signal POL controls the polarity of data voltages supplied to the pixels.

The timing controller 101 increases the frame rate to an input frame rate×N (where N is a positive integer of 2 or greater) Hz of the input image to control the display panel drivers 102, and 103 at the frame rate multiplied by N times in the normal driving mode. The input frame rate is 60 Hz in the NTSC (National Television Standards Committee) system and 50 Hz in the PAL (Phase-Alternating Line) system.

The data driver 102 comprises one or more source drive ICs. Each source drive IC comprises a shift register, a latch, a digital-to-analog converter (hereinafter, "DAC"), and an output buffer. Each source driver receives digital video data of an input image from the timing controller 101, samples the received digital video data, and latches the sampled data. The source drive ICs convert digital video data of an input image to gamma-compensated voltages to generate positive and negative data voltages, and reverse the polarity of the data voltages in response to a polarity control signal. The source drive ICs output the data voltages to the data lines through the output buffers in response to a source output enable signal SOE.

The gate driver 103 comprises a shift register and a level shifter. The gate driver 103 sequentially supplies gate pulses synchronized with data voltages to the gate lines GL, in response to a gate timing control signal GDC.

The host system 104 may be implemented as one of the following: a television system, a home theater system, a set-top box, a navigation system, a DVD player, a Blu-ray player, a personal computer PC, and a phone system. The host system 104 scales digital video data RGB of an input image to the resolution of the display panel 100. The host system 104 sends timing signals Vsync, Hsync, DE, and CLK to the timing controller 101, along with the digital video data RGB of the input image. The host system 104 executes an application program associated with the coordinate information of a touch input from the touch sensor driver.

The target level generator 105 predicts a ripple in common voltage Vcom according to the result of analysis of data of an input image, and outputs target level data for compensating for the ripple. The target level data is digital data that indicates the voltage level of the common voltage Vcom applied to the common electrode 2. The target level generator 105 analyzes the data of the input image, adds up data of each polarity for 1 line of the display panel 100, and calculates an unbalance of polarity in data voltage for each line of the display panel 100 and the amount thereof. As shown in FIGS. 1 to 4, when there is a polarity bias in data voltage, the ripple in common voltage Vcom becomes larger in proportion to the transition width of the data voltage and the amount of the unbalance of polarity. Accordingly, once the amount of the unbalance of polarity in data for 1 line is calculated, a relatively accurate amount of ripple in common voltage can be predicted.

The target level generator 105 predicts the amount of ripple in common voltage based on the result of data analysis, and generates target level data for ripple-free common voltage for every horizontal period. 1 horizontal period 1H is the time needed to write data to 1 line of pixels on the display panel 100. The target level data is supplied to the Vcom generator 120. The target level generator 105 may send the target level data to the Vcom selector 110 and the Vcom generator 120 via a serial peripheral interface (SPI) which is a standard interface.

The target level generator 105 is described in detail in U.S. patent application publication No. US 2014/0092077 A1 dated on Apr. 3, 2014 by the present applicant.

The target level generator 105 may include an operation block and a characteristic parameter block. The operation block may generate the target level data using the received data of input image and a characteristic parameter. The operation block may calculate a changed amount of a data voltage for each data line DL on a current line on the display panel 100. For example, a changed amount of a data voltage on the n-th line of an m-th data line DL can be calculated by subtracting a voltage of the (n−1)-th line from the voltage of the n-th line. That is, by subtracting data Dn−1 of the (n−1)-th line from data Dn of the n-th line with respect to the m-th data line DL, a changed amount of a data voltage $\Delta Dn=Dn-Dn-1$ of the n-th line can be calculated. Here, the data of input image may be a pixel data to which a gamma voltage and polarity have been reflected. The pixel data input to the operation block corresponds to gradation-based digital data for representing a gradation level. The operation block may convert the received data into voltage-based digital data for representing a voltage to be output to a data line DL. Upon the data conversion, gamma correction may be performed on the received data to calculate the corresponding data voltage value. Also, the corresponding data voltage value may be set with a polarity according to inversion driving. For example, if a data voltage that is to be output is positive, a positive data voltage value may be set, and if a data voltage that is to be output is negative, a negative data voltage value may be set. Thereby, image data for representing a voltage that is to be actually output to the data line DL may be calculated. Accordingly, the operation block 211 calculates a changed amount of a voltage for each data line DL based on analysis of the data of input image.

If the changed amount of the voltage for each data line DL is calculated, the operation block calculates a total sum SUM_ΔDn of the changed amounts of voltages for the current line. That is, if the display panel 100 includes first through m-th data lines DL1 to DLm, the operation block calculates a total sum of the changed amounts of voltages for the n-th line by calculating $SUM_\Delta Dn=\Delta Dn_DL1+\Delta Dn_DL2+\Delta Dn_DL3+\ldots+\Delta Dn_DLm$.

If the total sum SUM_ΔDn of the changed amounts of voltages for the n-th line is calculated, the ripple component of the common voltage Vcom may be estimated based on the total sum of the changed amounts of the voltages. Accordingly, the operation block generates target level data corresponding to an appropriate compensation level so that a common voltage level Vcom capable of compensating for the estimated ripple component can be output. The target level data according to total sums of changed amounts of voltages may be stored in the form of a memory of lookup table in the timing controller 101.

A characteristic parameter is selected by the characteristic parameter block. For example, the characteristic parameter may be selected according to the location of a line on the display panel 100. The selected characteristic parameter P is input to the operation block. Accordingly, the operation block reflects the selected characteristic parameter to the target level data. For example, the operation block may multiply the target level data by the characteristic parameter to thereby compensate for the target level data according to the characteristics.

Meanwhile, the characteristic parameter block may update the characteristic parameter periodically. The update operation may be performed in unit of a frame.

The Vcom selector 110 generates a selection signal for alternately selecting a preset reference level and a target level and controls the Vcom generator 120, in order to allow the common voltage Vcom to reach a target level quickly. The Vcom selector 110 calculates the high width of an SPI enable signal by counting clocks SCLK required for serial data transmission in SPI communication, and selects the reference level and target level of the common voltage Vcom based on the high width.

The Vcom generator 120 decodes the target level data and outputs a common voltage Vcom to apply to the common electrode 2 of the display panel 100. The Vcom generator 120 selects the voltage level of the common voltage Vcom under control of the Vcom selector 110. The common voltage Vcom output from the Vcom generator 120 makes a transition, not from a first target level directly to a second target level, but from the first target level to the reference level and then to the second target level. Thus, the common voltage Vcom may be quickly changed to a target level.

Figure 6:
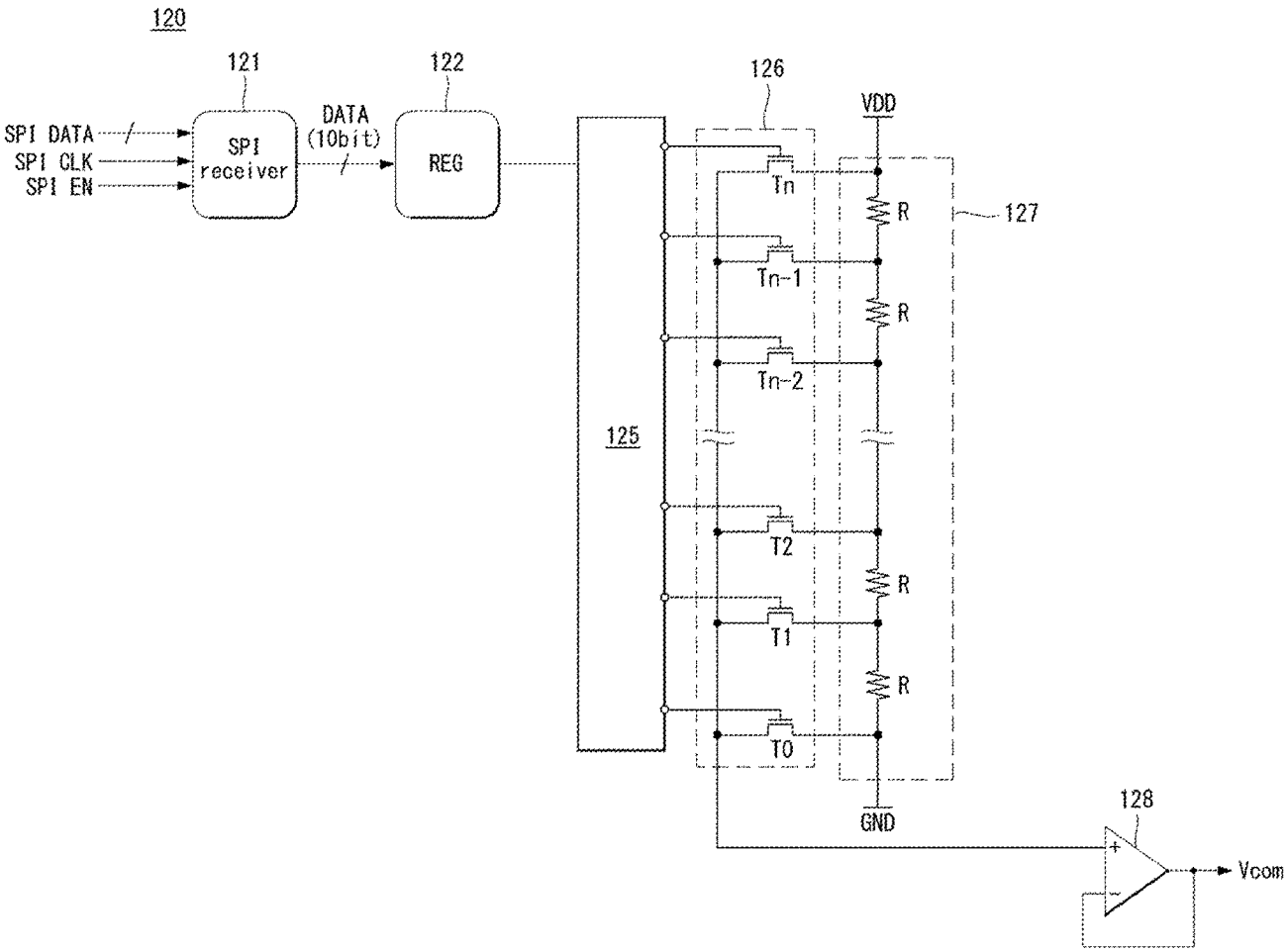
FIGS. 6 and 7 are circuit diagrams of a Vcom generator shown in FIG. 5.
Figure 7:
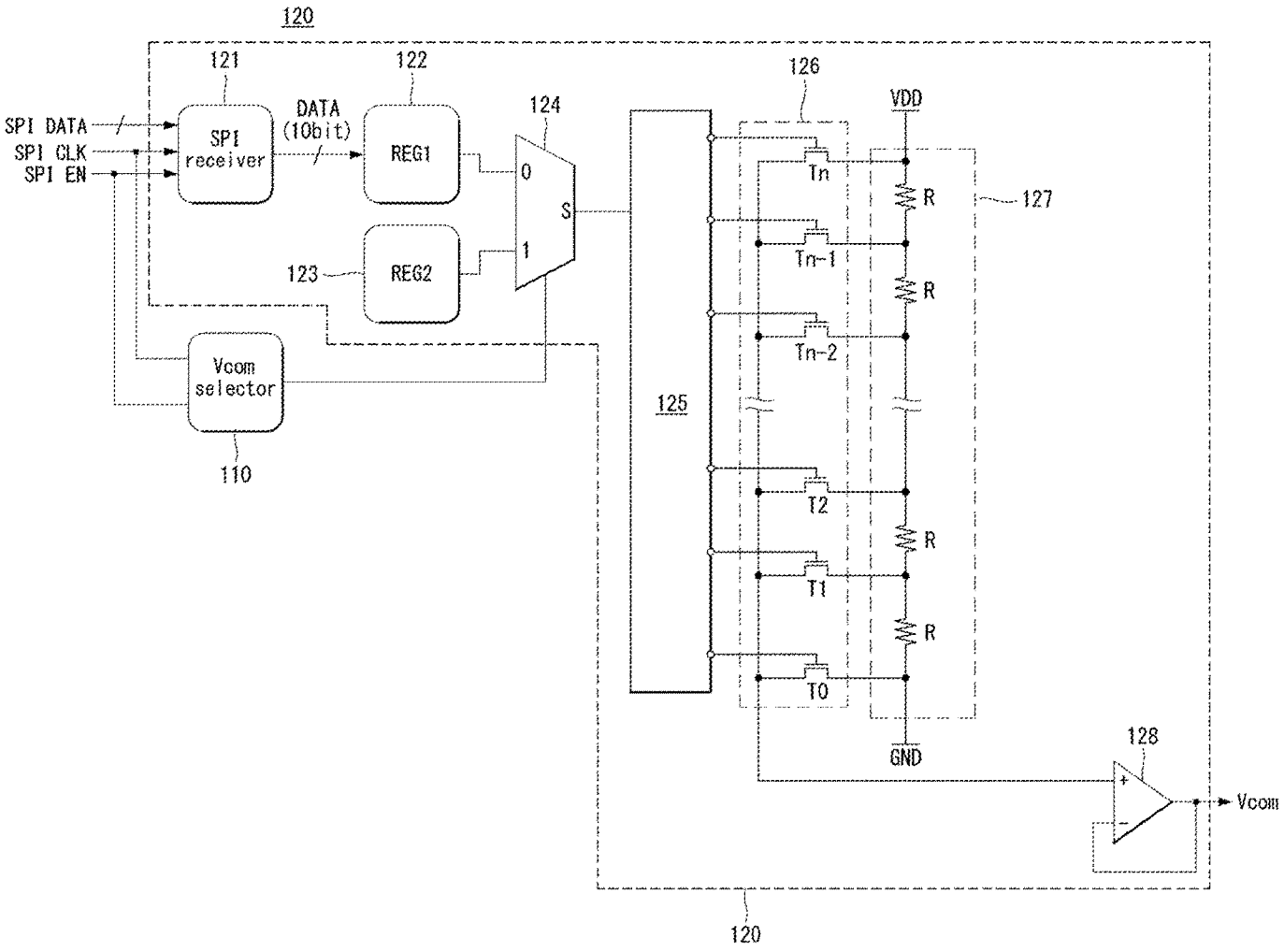

The Vcom generator 120 may be implemented as the circuit shown in FIG. 6 or 7. In FIGS. 6 and 7, the target level data SPI DATA is illustrated as, but not limited to, 10-bit digital data that is serially transmitted via SPI.

Referring to FIG. 6, a Vcom generator 120 according to an aspect of the present disclosure comprises an SPI receiver 121, a register (REG) 122 that receives serial data SPI DATA through the SPI receiver 121, and a voltage output part that outputs a voltage indicated by the data output from the register (REG) 122. The output voltage part comprises a decoder 125, a switch array 126, and a voltage-dividing circuit 127.

The SPI receiver 121 receives an SPI enable signal SPI EN, serial data SPI DATA, and clocks SPI CLK. The serial data SPI DATA comprises target level data for compensating for a ripple in common voltage Vcom. A voltage corresponding to the target level data is varied according to the result of analysis of the input image.

The SPI receiver 121 reads target level data for the common voltage, which is received as serial data SPI DATA through an SPI communication protocol, in sync with the clocks SPI CLK. The SPI receiver 121 starts sending target level data SPI DATA to the register 122 on the falling edge of the SPI enable signal SPI EN. The register 122 stores the target level data for the common voltage received from the SPI receiver 121 and transmits the previously stored target level data to the decoder 125.

The decoder 125 decodes the target level data received from the register 122 into control signals for controlling the on/off of switches T0 to Tn constituting the switch array 126.

The switch array 126 comprises a plurality of switches T0 to Tn. Gates of the switches T0 to Tn are connected as a one-to-one relationship to output terminals of the decoder 125 and receive a control signal. Sources of the switches T0 to Tn are connected to nodes between resistors R in the voltage-dividing circuit 127. Drains of the switches T0 to Tn are connected to a buffer 128. The buffer 128 may be implemented as a voltage follower comprising an operational amplifier OP-AMP. One of the switches T0 to Tn is turned on in response to a control signal from the decoder 125 and selects a voltage from the voltage-dividing circuit 127 as the common voltage Vcom. The common voltage Vcom output through the switch array 126 is supplied to the common electrode 2 on the display panel 100 through the buffer 128.

The voltage-dividing circuit 127 comprises a plurality of resistors R connected in series between a high-potential power-supply voltage VDD and a ground voltage GND. Voltages of different voltage levels are generated through the nodes between the adjacent resistors R, and one of the voltages is output to the common electrode 2 through the switch.

Referring to FIG. 7, a Vcom generator 120 according to another aspect of the present disclosure comprises an SPI receiver 121, a first register (REG1) 122, a second register (REG2) 123, a decoder 125, a multiplexer (MUX) 124, a switch array 126, and a voltage-dividing circuit 127. The receiver 121, first register 122, second register 123, decoder 125, switch array 126, and voltage-dividing circuit 127 are similar to the circuit shown in FIG. 6, so a repetitive description thereof will be omitted.

The second register 123 stores reference level data indicating a reference level for the common voltage Vcom. As in FIGS. 9 and 11, the reference level Vcom_ref (7V) is a voltage that is lower than a first target voltage TG_14V and higher than a second target voltage TG_1V, through which the common voltage Vcom transitions between the first target voltage TG_14V and the second target voltage TG_1V. The first target voltage TG_14V is a positive voltage that is higher than the reference level Vcom_ref (7V). The second target voltage TG_1V is a negative voltage that is lower than the reference level Vcom_ref (7V).

When the high width of the SPI enable signal SPI EN is i clocks SCLK or more (where i is a positive integer equal to or greater than 2), the Vcom selector 110 generates a selection signal of first logical value. When the high width of the SPI enable signal SPI EN is j clocks SCLK (where j is a positive integer equal to or greater than 1 and less than i), the Vcom selector 110 generates a selection signal of second logical value. Although, in FIG. 11, i is 2 and j is 1 by way of example, the present disclosure is not limited thereto. For example, i may be 3, and j may be 2. In FIGS. 6 and 7, the first logical value is 0 (zero or low level) and the second logical value is 1 (or high level), or vice versa, by way of example.

The multiplexer 124 selects target level data from the first register 122 and transmits the selected target level data to the decoder 125, in response to the first logical value of the selection signal received from the Vcom selector 110, and selects reference level data from the second register 123 and transmits the selected reference level data to the decoder 125, in response to the second logical value of the selection signal. The multiplexer 124 outputs the target level data and the reference level data within 1 horizontal period 1H.

The decoder 125 decodes data received from the first register 122 or second register 123 that is selected by the Vcom selector 110 into control signals for controlling the on/off of the switches T0 to Tn constituting the switch array 126.

The switch array 126 outputs a voltage selected between VDD and GND in response to a control signal input from the decoder 125. A target level voltage and reference level voltage for the common voltage Vcom output through the switch array 126 are supplied to the common electrode 2 through the buffer 128.

In the Vcom generator 120 of FIG. 6, the reference level interval in 1 horizontal period may be lengthened due to the SPI communication protocol, thus making the target level interval relatively shorter. When the common voltage Vcom changes to the target level through the reference level interval, the common voltage Vcom may reach the target level quickly. However, when the target level interval is shortened, the efficiency of compensation for a ripple in common voltage Vcom is decreased. In contrast, in the Vcom generator 120 of FIG. 7 which additionally has the Vcom selector 110 and the multiplexer 124, the reference level interval for the common voltage Vcom in 1 horizontal period may be reduced to less than ½ horizontal period, thereby allowing the common voltage Vcom to reach the target level quickly and increasing compensation efficiency.

FIG. 8 is a waveform diagram showing how the common voltage varies with each horizontal period.

Figure 8A:
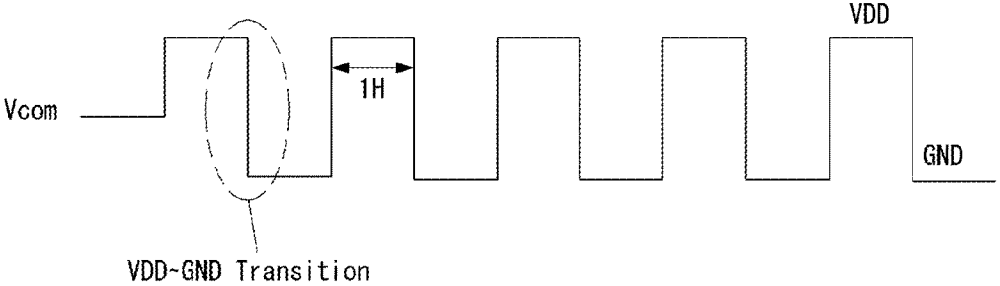
FIGS. 8A to 8C are waveform diagrams showing how a common voltage varies with each horizontal period.

Referring to FIG. 8, the common voltage Vcom of this disclosure is varied based on the result of analysis of data of an input image. The target level for the common voltage Vcom may get higher as the data change rate gets higher and the data polarity bias becomes more severe. The target level comprises a first target level of positive polarity and a second target level of negative polarity. As shown in FIG. 8A, the common voltage Vcom may be generated at the first target level in a first horizontal period and then at the second target level in a second horizontal period.

Figure 8B:
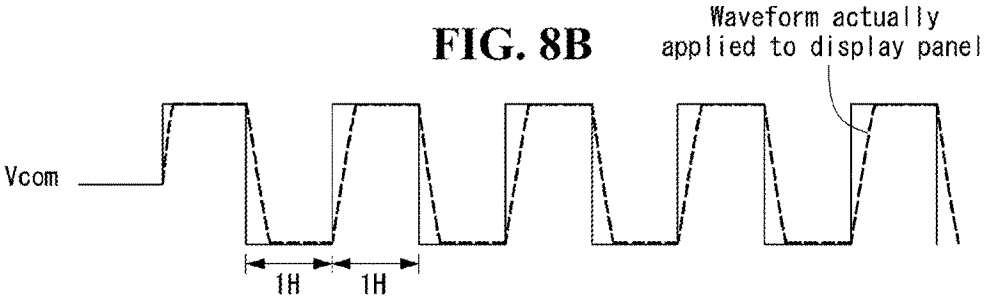

If the transition width between the target levels of the common voltage Vcom is wide, that is, the common voltage Vcom swings widely, the waveform of the common voltage Vcom actually applied to the display panel 100 has a longer transition interval (rising/falling edge). Therefore, as shown in FIG. 8B, the time to reach a target level is lengthened, and the target level hold time is shortened. This phenomenon causes a decrease in the compensation efficiency of the common voltage Vcom. The higher resolution and larger size the display panel 100 has, the larger the RC load on the display panel 100, making the transition interval of the common voltage Vcom longer.

Figure 8C:
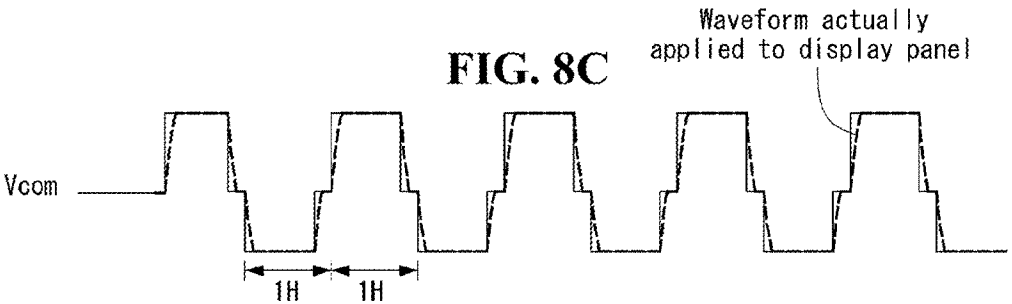
Figure 9:
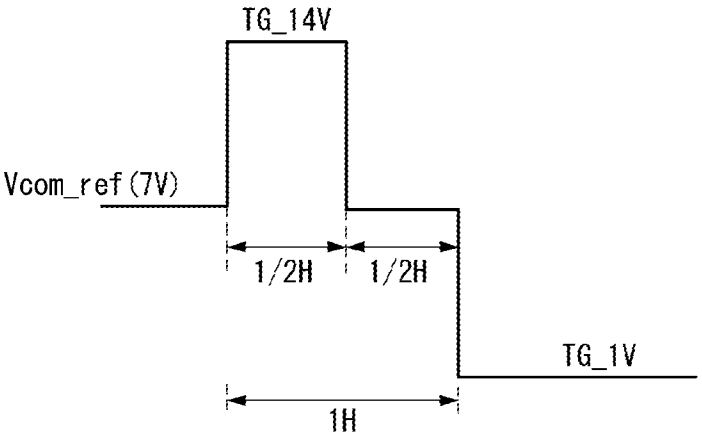
FIGS. 9 and 10 are waveform diagrams showing an operation and an output waveform of the Vcom generator according to an aspect of the present disclosure.
Figure 11:
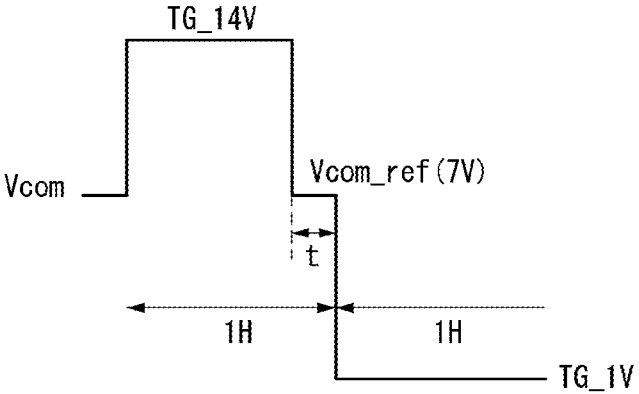
FIGS. 11 and 12 are waveform diagrams showing an operation and an output waveform of the Vcom generator according to another aspect of the present disclosure.

In the present disclosure, as shown in FIG. 8C, the common voltage waveform is controlled to exhibit multiple steps so that the common voltage Vcom reaches a target level quickly. For a voltage transition from the first target level to the second target level or vice versa, a multi-step common voltage changes to another level through the reference level. FIG. 9 shows a multi-step waveform common voltage output from the Vcom generator (FIG. 6) according to an aspect of the present disclosure. FIG. 11 shows a multi-step waveform common voltage output from the Vcom generator (FIG. 7) according to another aspect of the present disclosure. The common voltages of FIGS. 9 and 11 can reach a target level quickly. The common voltage of FIG. 11 has better ripple compensation efficiency since the target level interval can be lengthened by drastically reducing the reference level interval.

Figure 10:
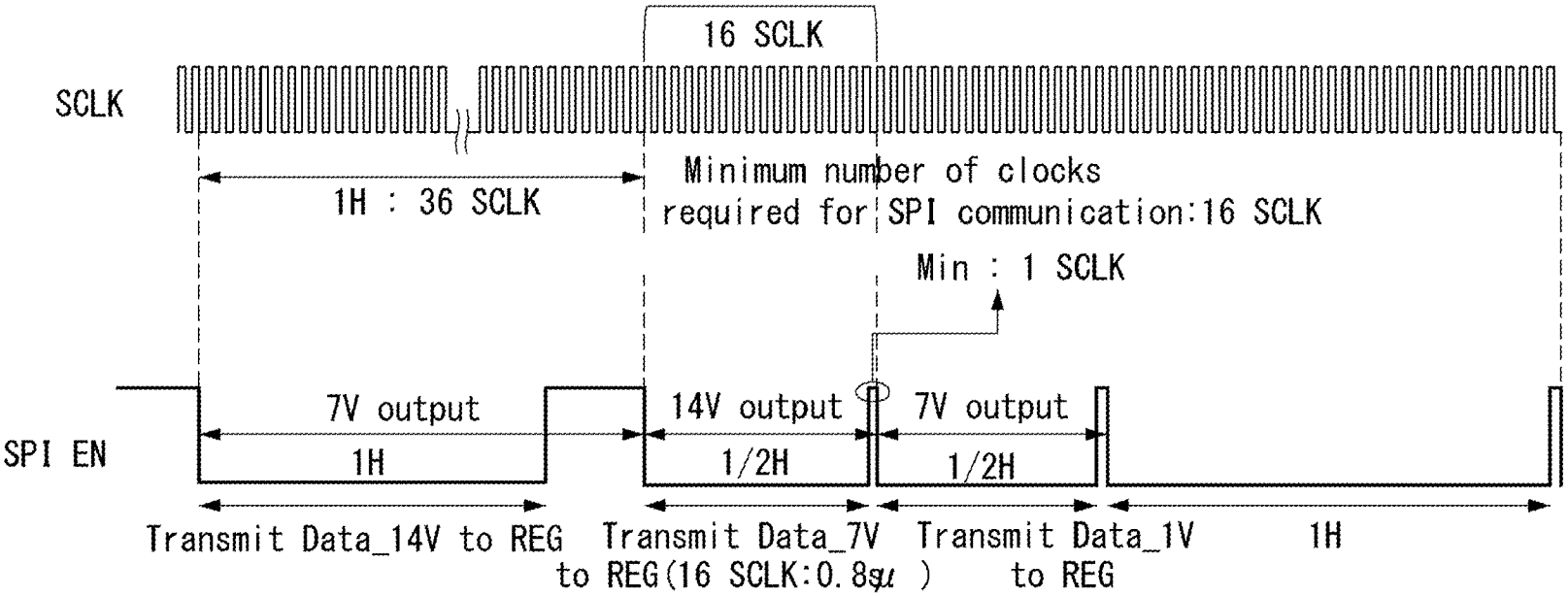

FIG. 9 is a waveform diagram of an output (common voltage) from the Vcom generator of FIG. 6. FIG. 10 is a waveform diagram showing the minimum data transfer time for the SPI communication protocol.

Referring to FIGS. 9 and 10, the Vcom generator 120 according to an aspect of the present disclosure outputs a common voltage Vcom whose reference level interval is longer than the minimum data transfer time allowed for the SPI communication protocol. The minimum data transfer time is the minimum number of clocks required for data transmission using the SPI communication protocol, that is, 16 SCLK.

This Vcom generator 120 stores (n−1)th data in the register 122, and stores nth data, i.e., the next data, in the register 122 when outputting the common voltage Vcom at the level indicated by the (n−1)th data. Thus, the Vcom generator 120 of FIG. 6 has to transmit data indicating whichever level to the register 122, in order to change the level of the common voltage Vcom. For this Vcom generator 120, the time required for data transmission is 16 SCLK, which equals the minimum number of clocks required for data transmission using the SPI communication protocol. Accordingly, when transmitting reference level data Data_7V subsequent to first target level data Data_14V to the register 122 via SPI communication, the reference level data Data_7V is transmitted to the register 122 for a transmission period of 16 SCLK or longer, and for this data transmission period ½H, the Vcom generator 120 outputs a voltage of 14 V for the pre-stored first target level data Data_14V. Subsequently, second target level data Data_1V is transmitted to the register 122, and for this data transmission period ½H, the Vcom generator 120 outputs a voltage of 7 V for the pre-stored reference level data Data_7V.

The minimum number of clocks, 16 SCLK, required for data transmission at the maximum transfer rate of 20 MHz for SPI is 0.8 μs. For a display panel 100 that has a 8K resolution and is driven at 120 Hz, 0.8 μs equals ½H. Thus, for a multi-step waveform common voltage shown in FIG. 8C generated by the Vcom generator 120 of FIG. 6, the reference level interval cannot be reduced to less than ½ horizontal period ½H. In contrast, the Vcom generator 120 of FIG. 7 allows for reducing the reference level interval because it is not restricted by the minimum transfer rate for SPI communication, thereby lengthening the target level interval and therefore increasing compensation efficiency enough.

Figure 12:
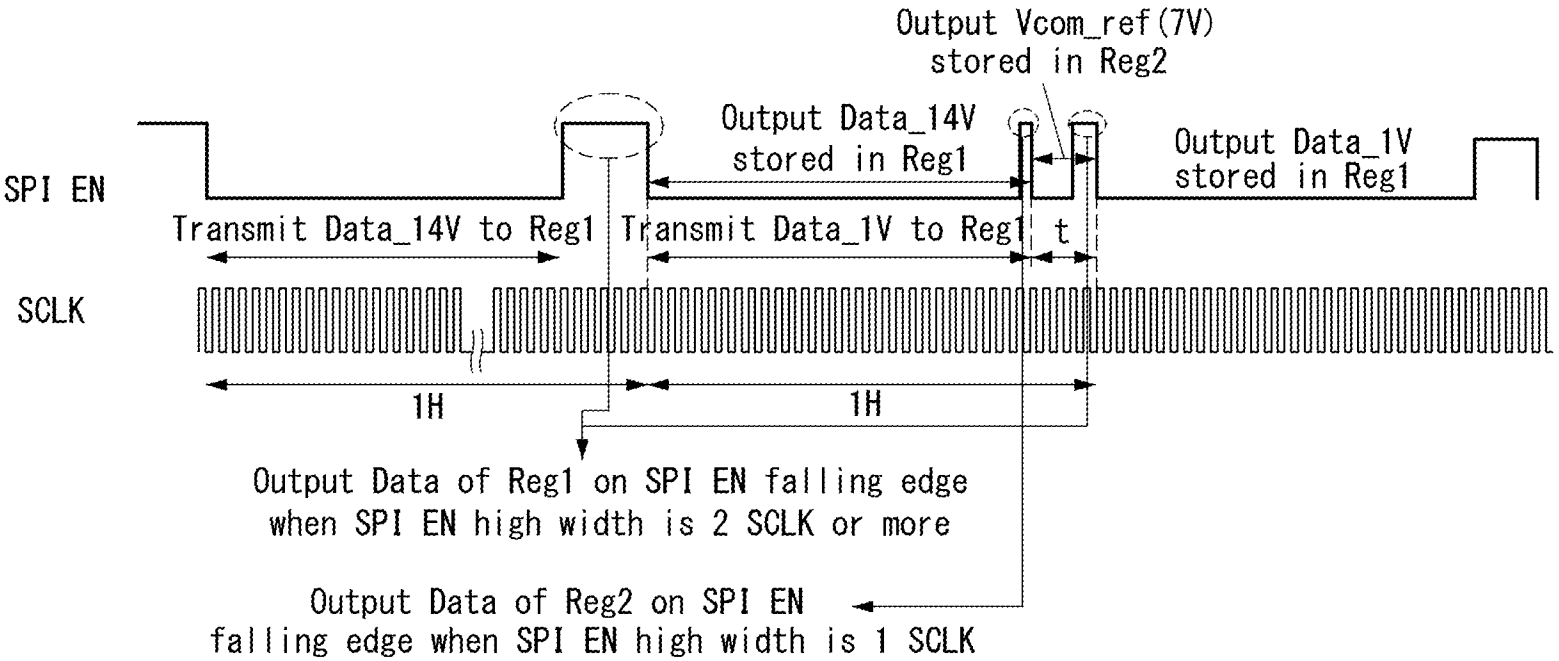

FIGS. 11 and 12 are waveform diagrams showing an operation and output waveform of the Vcom generator (120 of FIG. 7) according to another aspect of the present disclosure. FIG. 11 is a waveform diagram showing an output (common voltage) from the Vcom generator 120 of FIG. 7. FIG. 12 is a waveform diagram showing the minimum number of clocks required for data transmission using the SPI communication protocol.

Referring to FIGS. 11 and 12, this Vcom generator 120 according to another aspect of the present disclosure outputs a common voltage having a reference level interval shorter than the minimum data transfer time for the SPI communication protocol. This Vcom generator 120 selects an output from the first or second register 122 and 123 in response to a selection signal input from the Vcom selector 110.

The Vcom selector 110 calculates the high width of an SPI enable signal SPI EN by counting clocks SCLK for SPI communication. When the high width of the SPI EN signal is i clocks SCLK or more, the Vcom selector 110 controls the multiplexer 124 at the falling edge of the SPI EN signal to output the target level data stored in the first register 122. Accordingly, when the high width of the SPI EN signal is i clocks SCLK or more, the Vcom generator 120 outputs a voltage of 14 V or 1 V at the target level output from the first register 122. In FIG. 12, i is "2" by way of example but not limited thereto.

The Vcom selector 110 counts clocks SCLK for SPI communication, and, when the high width of the SPI EN signal is j clocks SCLK (where j is a positive integer equal to or greater than 1 and less than i), controls the multiplexer 124 at the falling edge of the SPI EN signal to output the reference level data stored in the second register 123. Accordingly, when the high width of the SPI EN signal is j clocks SCLK, the Vcom generator 120 outputs a voltage of 7V or 1 V at the reference level output from the second register 123. In FIG. 12, j is "1" by way of example but not limited thereto.

The reference level data Data_7V is not received via SPI communication, but stored in the second register 123 that is separated from the SPI communication path. As described above, using the Vcom selector 110 and the multiplexer 124, the reference level data Data_7 is output to the decoder 125 for a period of time less than ½ horizontal period.

The first register 122 receives target level data through the SPI receiver 121 and temporarily stores it. First target level data Data_14V is transmitted to and stored in the first register 122 for a first horizontal period 1H, and then second target level data Data_1V is transmitted to and stored in the first register 122 for a second horizontal period 1H. The first target level data 14V and the second target level data 1V each are transmitted to the first register 122 for 1 horizontal period 1H. As illustrated in FIG. 12, for 1 horizontal period 1H during which target level data Data_14V or Data_1V is transmitted to the first register 122, a target level voltage of 14 V or 1 V and a reference level voltage 7V may be output from the Vcom generator 120. Accordingly, the output of a target level voltage and a reference level voltage and the transmission of target level data to a register may be processed in parallel.

As shown in FIGS. 11 and 12, the Vcom generator 120 of FIG. 7 may output a common voltage with a reference level interval shorter than the minimum data transfer time for the SPI communication protocol. As a result, the common voltage Vcom may reach a target level quickly within 1 horizontal period, and, as illustrated in FIG. 11, the target level interval is longer than ½ horizontal period, thereby improving compensation efficiency. As illustrated in FIGS. 11 and 12, the reference level interval t is shorter than ½ horizontal period ½ H, and also is shorter than the minimum data transfer time 16 SCLK for SPI.

Figure 13:
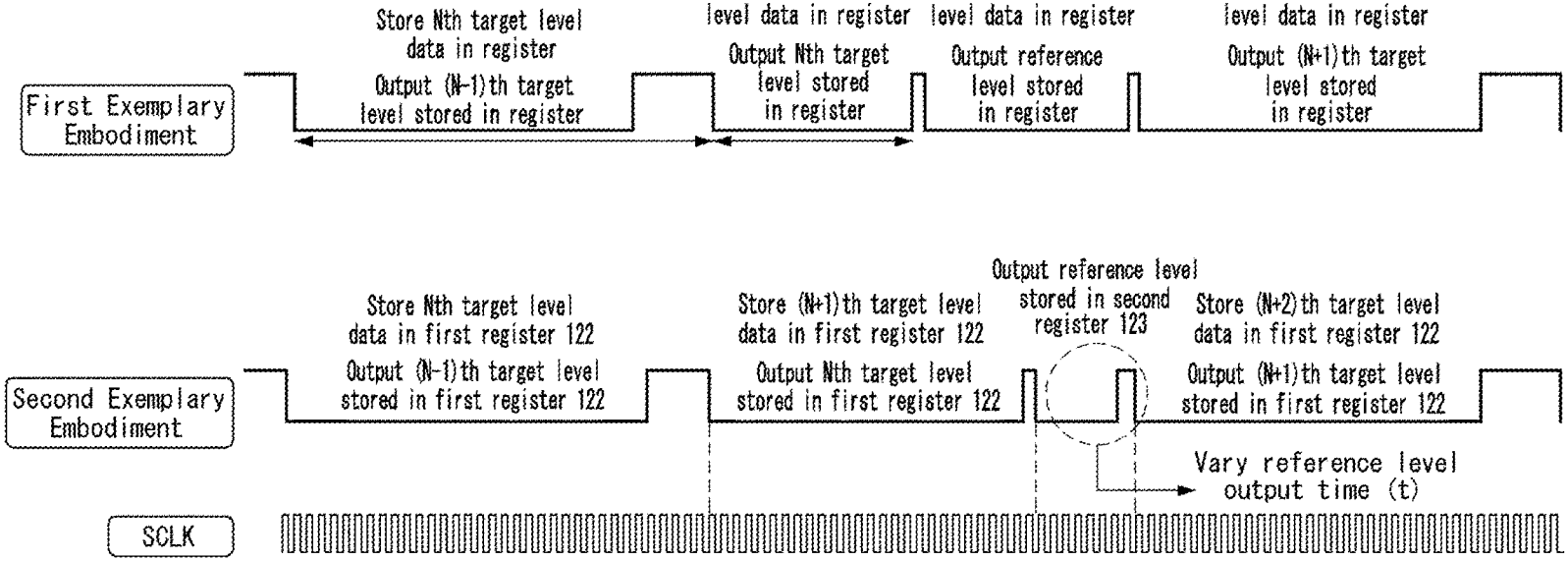
FIG. 13 is a waveform diagram drawing a comparison between reference level intervals of the Vcom generators according to aspects of the present disclosure.

FIG. 13 is a waveform diagram drawing a comparison between reference level intervals of the Vcom generators according to the aspects of the present disclosure.

Referring to FIG. 13, the Vcom generator 120 according to another aspect of the present disclosure may output a reference level for a period of time less than the minimum data transfer time allowed for SPI communication, and may vary that period of time depending on the transition width between target levels for compensating for a ripple in common voltage. If the transition width of the common voltage becomes larger, the voltage changes to the reference level and then to another target level within a shorter time, thereby shortening the transition interval between the target levels and lengthening the target level interval.

Figure 14:
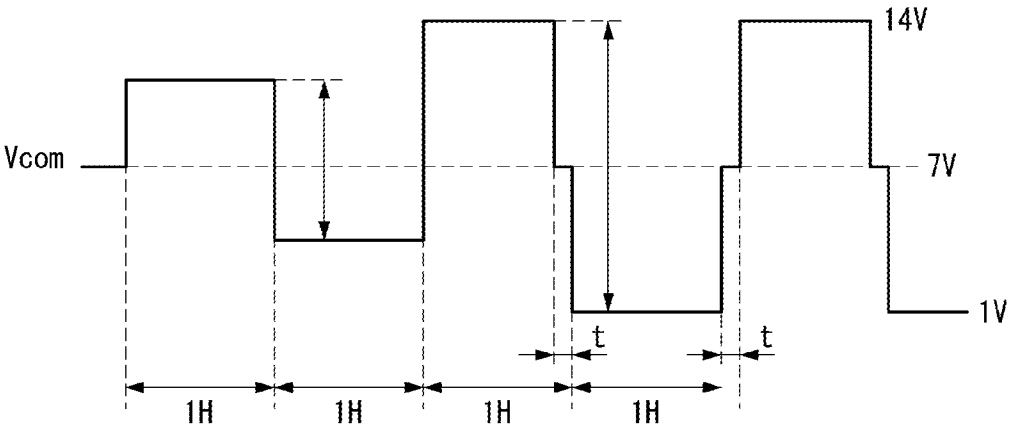
FIG. 14 is a waveform diagram showing an example of a variation in reference level interval length with respect to data transition width.

The Vcom selector 110 determines the transition width of the common voltage between first and second target voltages by comparing first and second target level data Data_14V and Data_1V. When the transition width is greater than a given reference value, the Vcom selector 110 may provide a reference level interval t for a period of time longer than 0 and shorter than ½ horizontal period, as shown in FIG. 14. On the contrary, when the transition width between the target voltages is less than the reference value, the Vcom selector 110 may control the reference level interval t to a minimum, for example, 0 (zero), as shown in FIG. 14. The Vcom selector 110 may vary the reference level interval of the common voltage Vcom by counting clocks SCLK from the falling edge of the SPI EN and outputting a selection signal for varying the reference level interval based on the count.

The present disclosure has been described with respect to an SPI interface as a standard serial interface. However, the present disclosure is not limited to it. For example, the present disclosure may be applicable to I2C communication, which is another standard serial interface, without significant changes.

As discussed above, in a liquid-crystal display device according to the present disclosure in which common voltage varies with each horizontal period according to the result of analysis of data voltage, the common voltage is controlled to have a multi-step waveform so that, when the transition width of the common voltage between first and second target voltages is large, the common voltage can change through a reference level voltage. As a result, the present disclosure allows the common voltage to reach the target voltages quickly within a limited amount of time, thereby preventing a ripple in common voltage even if the transition width of the common voltage is large. Particularly, the present disclosure allows for reducing the reference level interval to less than ½ horizontal period, for example, which is the minimum data transfer time allowed for SPI communication, and this may further increase ripple compensation efficiency.

Although aspects have been described with reference to a number of illustrative aspects thereof, it should be understood that numerous other modifications and aspects can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display device, comprising:

a display panel;

a target level generator calculating an unbalance of polarity in data voltages for each line of the display panel, generating target level data based on the calculated unbalance and outputting the target level data during every horizontal period; and a multi-step common voltage generator outputting a target voltage corresponding to the target level data and a reference level voltage corresponding to preset reference data within a one horizontal period as a common voltage, wherein the multi-step common voltage generator outputs first and second target voltages within first and second horizontal periods, respectively, wherein the multi-step common voltage generator outputs the reference level voltage for a ½ horizontal period or less, between the first and second target voltages, and the reference level voltage is lower than the first target voltage and higher than the second target voltage.

2. The liquid crystal display device of claim 1, wherein the multi-step common voltage generator receives the target level data through a serial peripheral interface (SPI) communication path and outputs the reference level voltage for a period of time less than a minimum transfer time allowed for an SPI communication protocol.

3. The liquid crystal display device of claim 2, wherein the multi-step common voltage generator comprises:

a common voltage selector receiving an SPI enable signal, serial data comprising the target level data, and clocks, and generating a selection signal for a first logical value when a high width of the SPI enable signal is i clocks or more (where i is a positive integer equal to or greater than 2), and generates a selection signal for a second logical value when the high width of the SPI enable signal is j clocks (where j is a positive integer equal to or greater than 1 and less than i);

an SPI receiver receiving the SPI enable signal, the serial data, and the clocks;

a first register receiving the target level data from the SPI receiver;

a second register separated from the SPI communication path and storing the reference level data;

a multiplexer outputting the target level data received from the first register in response to the selection signal of the first logical value and the reference level data from the second register in response to the selection signal of the second logical value; and a voltage output part selecting respective voltages corresponding to the target level data and the reference level data received from the multiplexer.

4. The liquid crystal display device of claim 3, wherein the multiplexer outputs the target level data and the reference level data within a one horizontal period.

5. The liquid crystal display device of claim 3, wherein the voltage output part comprises a decoder receiving the target level data from the common voltage selector and the reference level data from the second register.

6. The liquid crystal display device of claim 5, wherein the voltage output part comprises a switch array outputting a voltage selected between a high potential power supply voltage and a ground voltage in response to a control signal input from the decoder.

7. The liquid crystal display device of claim 6, wherein the switch array outputs the target level voltage and the reference level voltage for the common voltage.

8. The liquid crystal display device of claim 7, wherein the voltage output part comprises a buffer receiving the target level voltage and the reference level voltage for the common voltage.

9. The liquid crystal display device of claim 3, wherein i is 2 and j is 1.

10. The liquid crystal display device of claim 2, wherein the multi-step common voltage generator comprises:

an SPI receiver receiving an SPI enable signal, a serial data and clocks and reading the target level data for the common voltage received as the serial data through an SPI communication protocol in synchronized with the clocks;

a register receiving the SPI enable signal, the serial data and the clocks from the SPI receiver wherein the serial data includes the target level data for compensating for a ripple in the common voltage corresponding to the target level data varied in accordance with the analyzed data of the input image; and a voltage output part selecting respective voltages corresponding to the target level data and the reference level data received from the register.

11. The liquid crystal display device of claim 10, wherein the SPI receiver sends the target level data the register on a falling edge of the SPI enable signal.

12. The liquid crystal display device of claim 10, wherein the register stores the target level data for the common voltage received from the SPI receiver and transmits a previously stored target level data.

13. The liquid crystal display device of claim 10 wherein the voltage output part comprises a decoder receiving the target level data from the register.

14. The liquid crystal display device of claim 13, wherein the voltage output part comprises a switch array outputting a voltage selected between a high potential power supply voltage and a ground voltage in response to a control signal input from the decoder.

15. The liquid crystal display device of claim 1, wherein the common voltage has a reference level interval varied depending on a transition width of the common voltage between the first and second target voltages.

16. The liquid crystal display device of claim 15 wherein the common voltage selector compares first target level data indicating the first target voltage and second target level data indicating the second target voltage, and provides a reference level interval for the common voltage for a period of time longer than 0 and shorter than the ½ horizontal period when the transition width between the first and second target voltages is greater than a given reference value, and controls the reference level interval to a minimum when the transition width is less than the reference value.

17. A driving method of a liquid crystal display device comprising a display panel including a pixel electrode to which a data voltage for an input image is applied and a common electrode to which a common voltage is applied, the method comprising:

calculating an unbalance of polarity in data voltages for each line of the display panel, generating target level data based on the calculated unbalance, and outputting the target level data during every horizontal period; and outputting a target voltage corresponding to the target level data and a reference level voltage corresponding to preset reference data within a one horizontal period as the common voltage to the common electrode, wherein the outputting the target voltage and reference level voltage as the common voltage outputs first and second target voltages within first and second horizontal periods, respectively, and outputs the reference level voltage for a ½ horizontal period or less, between the first and second target voltages, and the reference level voltage is lower than the first target voltage and higher than the second target voltage.

18. The method of claim 17, wherein the target level data is received through a serial peripheral interface (SPI) communication path in the outputting the common voltage to the common electrode, and the reference level voltage is output for a period of time less than a minimum transfer time allowed for a SPI communication protocol.

19. The method of claim 18, wherein the outputting the outputting the target voltage and reference level voltage as the common voltage comprises:

generating a selection signal for a first logical value when a high width of an SPI enable signal is i clocks or more (where i is a positive integer equal to or greater than 2), and generating a selection signal for a second logical value when the high width of the SPI enable signal is j clocks (where j is a positive integer equal to or greater than 1 and less than i);

receiving the SPI enable signal, serial data comprising the target level data, and the clocks through an SPI receiver;

transmitting the target level data to a first register through the SPI receiver;

pre-storing the reference level data in a second register that is separated from the SPI communication path; and selecting respective voltages corresponding to the target level data and reference level data received by a multiplexer of a voltage output part, wherein the multiplexer supplies the target level data from the first register to the voltage output part in response to the selection signal for the first logical value, and supplies the reference level data from the second register to the voltage output part in response to the selection signal for the second logical value.

20. The method of claim 19, wherein i is 2 and j is 1.

* * * * *